US009282822B2

(12) United States Patent
Hogue

(10) Patent No.: US 9,282,822 B2
(45) Date of Patent: Mar. 15, 2016

(54) MULTI-ADJUSTABLE MULTI-POSITION SEATING APPARATUS

(71) Applicant: Earl Wayne Hogue, Shreveport, LA (US)

(72) Inventor: Earl Wayne Hogue, Shreveport, LA (US)

( * ) Notice: Subject to any disclaimer, the term of this patent is extended or adjusted under 35 U.S.C. 154(b) by 118 days.

(21) Appl. No.: 14/093,418

(22) Filed: Nov. 30, 2013

(65) Prior Publication Data

US 2015/0150376 A1 Jun. 4, 2015

(51) Int. Cl.
*A47C 1/026* (2006.01)
*A47C 3/34* (2006.01)

(52) U.S. Cl.
CPC .. *A47C 1/026* (2013.01); *A47C 3/34* (2013.01)

(58) Field of Classification Search
CPC ..... A47C 1/026; A47C 3/34
USPC ..... 297/183.5, 377, 354.12, 357, 354.1, 297/340, 341, 342, 382, 353, 344.12
See application file for complete search history.

(56) References Cited

U.S. PATENT DOCUMENTS

| | | | | | |
|---|---|---|---|---|---|
| 36,441 | A | | 9/1862 | Skinner | |
| 226,475 | A | | 4/1880 | Bell | |
| 514,403 | A | | 2/1894 | Allen | |
| 845,089 | A | * | 2/1907 | Leavitt | 105/421 |
| 1,215,609 | A | | 2/1917 | Arnold | |
| 2,010,429 | A | | 8/1935 | Glass | |
| D109,239 | S | | 4/1938 | Wolpin | |
| 2,182,516 | A | | 12/1939 | Coble | |
| 2,797,738 | A | | 7/1957 | Patterson | |
| 2,917,104 | A | | 12/1958 | Cottle | |
| 3,135,551 | A | | 6/1964 | Andreoli | |
| 3,414,321 | A | | 12/1968 | Beck | |
| 3,737,926 | A | | 6/1973 | Hermanson | |
| 3,934,932 | A | | 1/1976 | Ekornes | |
| 4,065,172 | A | | 12/1977 | Gawlinski | |
| 4,126,355 | A | | 11/1978 | Rosenbeck | |
| 4,155,126 | A | * | 5/1979 | Classen | 4/661 |
| 4,614,377 | A | | 9/1986 | Luo | |
| 4,707,023 | A | | 11/1987 | Hickey | |
| 4,867,505 | A | | 9/1989 | Parker | |
| 4,976,492 | A | | 12/1990 | Zielger | |
| 5,120,071 | A | | 6/1992 | Thibault | |
| 5,127,705 | A | | 7/1992 | Antoine | |
| 5,186,382 | A | | 2/1993 | Doughty | |
| 5,246,265 | A | | 9/1993 | Nagan | |
| 5,423,592 | A | | 6/1995 | Spurrier | |
| 5,427,435 | A | | 6/1995 | Yoder, Jr. | |
| 5,464,270 | A | | 11/1995 | Change | |
| 5,494,333 | A | | 2/1996 | Wilson | |
| 5,536,063 | A | | 7/1996 | Cable | |
| 5,556,166 | A | | 9/1996 | Synnestvedt | |

(Continued)

*Primary Examiner* — Syed A Islam

(57) ABSTRACT

A customizable multiple adjustment and multiple position seating apparatus or chair with independently adjustable front and rear seat height or elevation and front to rear seat slope; adjustable seat length or distance from the front of the seat to the rise of the backrest; and 180° pivoting/reclining backrest. Height of the front of the seat is adjustable from flat near the ground to armrest elevation. The rear of the seat, independent from front adjustments, is adjustable from near ground level to just below armrest level. Independent adjustability allows the seat to be positioned at multiple elevations and incline angles. Numerous backrest recline angle settings are obtainable throughout the 180° pivotability as well as numerous seat lengths. The backrest pivots to a forward position to become a handle for wheelbarrow-like mobility and the apparatus can be further rotated vertically and rested on the backend for a smaller storage profile.

10 Claims, 7 Drawing Sheets

(56) References Cited

U.S. PATENT DOCUMENTS

| | | | |
|---|---|---|---|
| 5,681,089 | A | 10/1997 | Lin |
| 5,911,469 | A | 6/1999 | Young |
| 5,931,526 | A | 8/1999 | Tseng |
| 5,988,737 | A | 11/1999 | Tomaiuolo |
| 6,003,946 | A | 12/1999 | Jackson |
| 6,056,353 | A | 5/2000 | Meata |
| 6,095,607 | A | 8/2000 | Wenzel |
| 6,206,472 | B1 | 3/2001 | Waugh |
| 6,238,001 | B1 | 5/2001 | Yoran |
| 6,840,580 | B2 | 1/2005 | Rodriguez |
| 6,871,911 | B2 | 3/2005 | Alexander, Jr. |
| D521,262 | S | 5/2006 | Wood |
| 7,207,622 | B2 | 4/2007 | Cohan et al. |
| 7,703,854 | B2 | 4/2010 | LaFreniere |
| 7,832,804 | B2 | 11/2010 | LaFreniere |
| 8,297,642 | B2 | 10/2012 | Tyson, III |
| 8,333,430 | B2 | 12/2012 | Adams |
| D674,205 | S | 1/2013 | Khamis |
| 8,356,823 | B1 | 1/2013 | Bergine |
| 8,403,418 | B2 | 3/2013 | Lindell |
| D679,917 | S | 4/2013 | Egbert |
| 8,449,026 | B1 | 5/2013 | Gutierrez |
| 8,469,449 | B2 | 6/2013 | Kao |
| 8,534,758 | B2 | 9/2013 | Rivera |
| 8,540,314 | B2 | 9/2013 | Fernandez |
| 8,550,547 | B1 | 10/2013 | Chung-Hsin |
| 8,550,558 | B2 | 10/2013 | Fu |

* cited by examiner

MULTI-ADJUSTABLE MULTI-POSITION SEATING APPARATUS

BACKGROUND

Numerous types, styles, and configurations of seating apparatuses or chairs are known in the prior art, including many variations of adjustable components. Adjustability in the prior art focuses mostly on reclinable backrests, foldability, or adjustable leg length. The much sought-after adjustability is intended to create a chair with improved customizability and increased comfort. For maximum comfort and customizability for the broadest range of users, a seating apparatus is needed that is significantly adjustable on multiple planes and axes including both the seat and backrest. A seating apparatus or chair is needed with adjustable seat slope, adjustable seat height, adjustable backrest reclinability, and adjustable distance between the front of the seat and the backrest junction.

SUMMARY

One embodiment of the multi-adjustable multi-position seating apparatus includes a frame, an adjustable multi-position seat, and an adjustable multi-position backrest.

The seat is slidably and pivotally mounted within the frame in both the front and rear of the seat. The front of the seat can be adjusted to numerous elevations from the bottom of the frame to the top. The rear of the seat can also be adjusted to numerous elevations from the bottom of the frame to nearly the top. The slope of the seat, the drop from front to rear, can be adjusted from a steep Adirondack chair style incline to a level position or even a decline from rear to front.

The backrest is slidably and pivotally mounted at its bottom to and above the seat while the upper reclinable adjustability is secured by a slidable mechanism along the vertical length of the backrest and selectable notches along the top of the frame. The distance between the front of the seat to the point where the backrest rises vertically away from the seat can be slidably adjusted forward or backward to comfortably fit the length of a user's legs. The backrest can also be positioned in multiple vertical or reclined angles by selecting the desired position and sliding the reclining adjustment mechanism into the corresponding notch along the top of the frame.

In one aspect of the chair, adjustment and subsequent stabilization of the front and back of the seat and the bottom of the backrest is accomplished with adjustment guide-latch-pivot assemblies slidably engaged on guide bars. Stabilization is achieved by spring-loaded pin latches on the guide-latch-pivots mounted on the guide bars which contain multiple holes along the length. An engaged latch is disengaged by pulling on the pin and compressing the spring retracting the pin from the hole, then adjustment is made by sliding the guide-latch-pivot along the guide bar. When the preferred position is reached, the pin is released and the spring causes the pin to enter the corresponding bore in the bar. The front and rear of the seat and the bottom of the backrest are pivotally connected to the guide-latch-pivots by rods inserted into tube-like connections which facilitate easy incline changes during height adjustments.

For moving, transport, or storage, the apparatus can be adjusted to the lower settings on both the front and rear, the reclining adjustment mechanism disengaged from the top of the frame, and the backrest rotated all the way forward until it contacts the seat near the ground in a mostly flat position along the ground or surface. The reclining adjustment mechanism engages stops on the front of the frame and the top of the backrest then is used as a handle to raise the front of the frame whereby wheels located on the back of the frame come in contact with the ground or surface in a wheelbarrow-like configuration. The front of the chair can be raised further until the frame is rotated into a fully vertical position where it is rested on frame mounted propstands and the wheels in a mostly level vertical position.

Advantages

Accordingly, several advantages of one or more aspects are to provide a seating apparatus or chair with the adjustability to be customized to fit almost any person of most any size, that allows the seat height and slope to be adjusted to fit most any sitter's desired comfort position, that allows the backrest to be adjusted to change the seat length to fit the sitter's leg length, that the backrest reclining angle can be adjusted to numerous desired angles, and that allows the chair to be easily moved or stored in an upright position.

Advantages include:

- Front of seat is adjustable up and down;
- Rear of seat is adjustable up and down;
- Entire seat height is adjustable up and down while also maintaining the same slope orientation;
- Seat slope is adjustable from a steep Adirondack chair style slope with rear of seat near ground level and front of seat at normal comfortable height to a flat orientation or even a decline from rear to front;
- Entire backrest is adjustable forward or backward shortening or lengthening the length of the seat or the distance between the front of the seat and the point where the backrest rises vertically away from the seat;
- Vertical angle or recline angle of the backrest is pivotal and adjustable of a 180° radius from a horizontal state or lounge-chair-like rearwardly recline to a forward position parallel to the angle of the seat, even a flat state at near ground level;
- Backrest pivotally transforms to a wheelbarrow-like handle for lifting the front of the seating apparatus in order to engage the rear facing wheels to the ground or surface for rolling or transport.
- Seat and backrest both adjust to a forward position in order to facilitate rotating the front of the seating apparatus upward 90° and onto its rear end to accommodate a smaller profile storage posture;
- Every conceivable adjustability a chair can possess on the two basic elements of a chair, the seat and the backrest, is disclosed in one embodiment of the seating apparatus.

Figure 1:
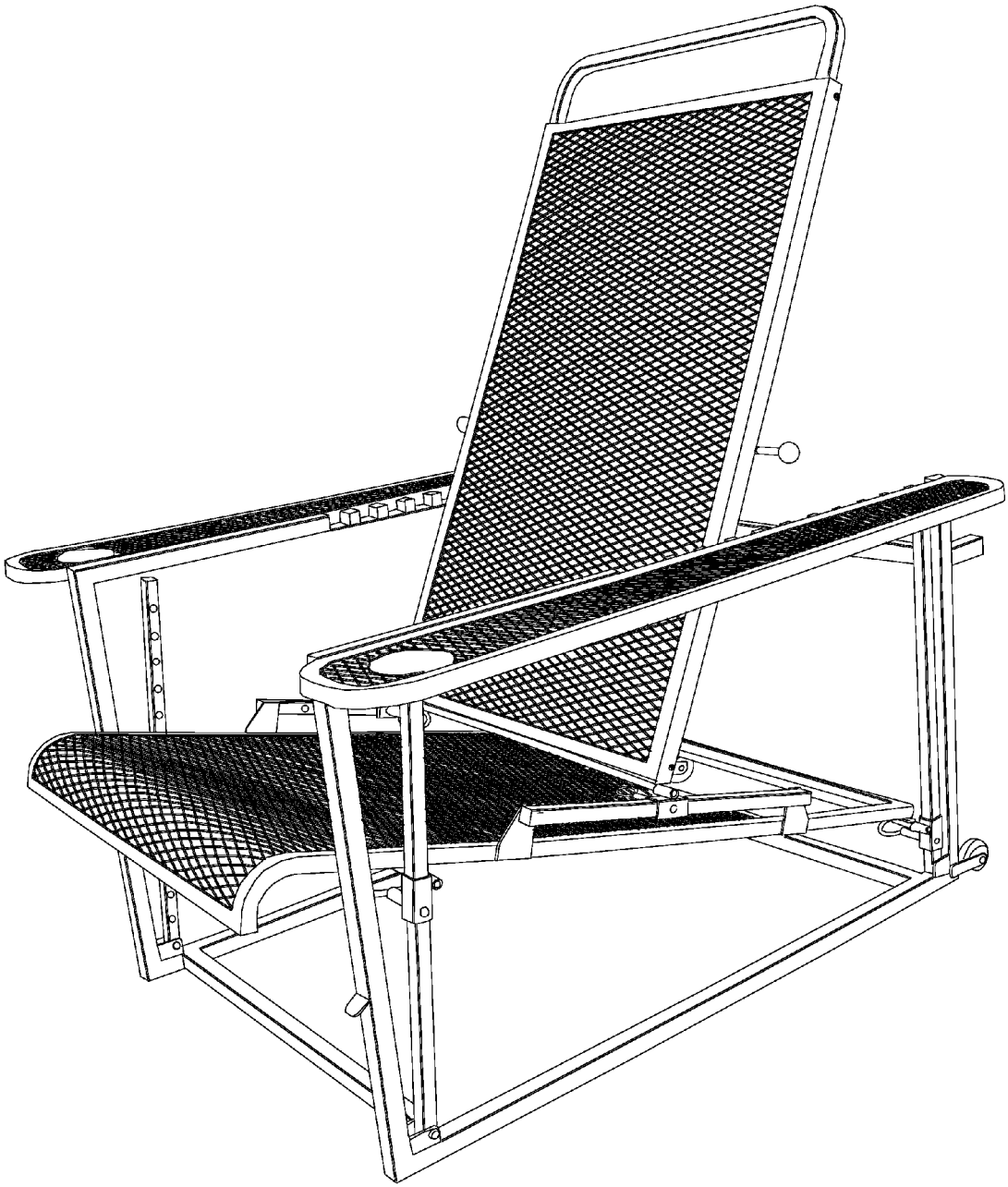
FIG. 1 is a perspective view of a completed representation of one embodiment of the multi-adjustable multi-position seating apparatus.
Figure 2:
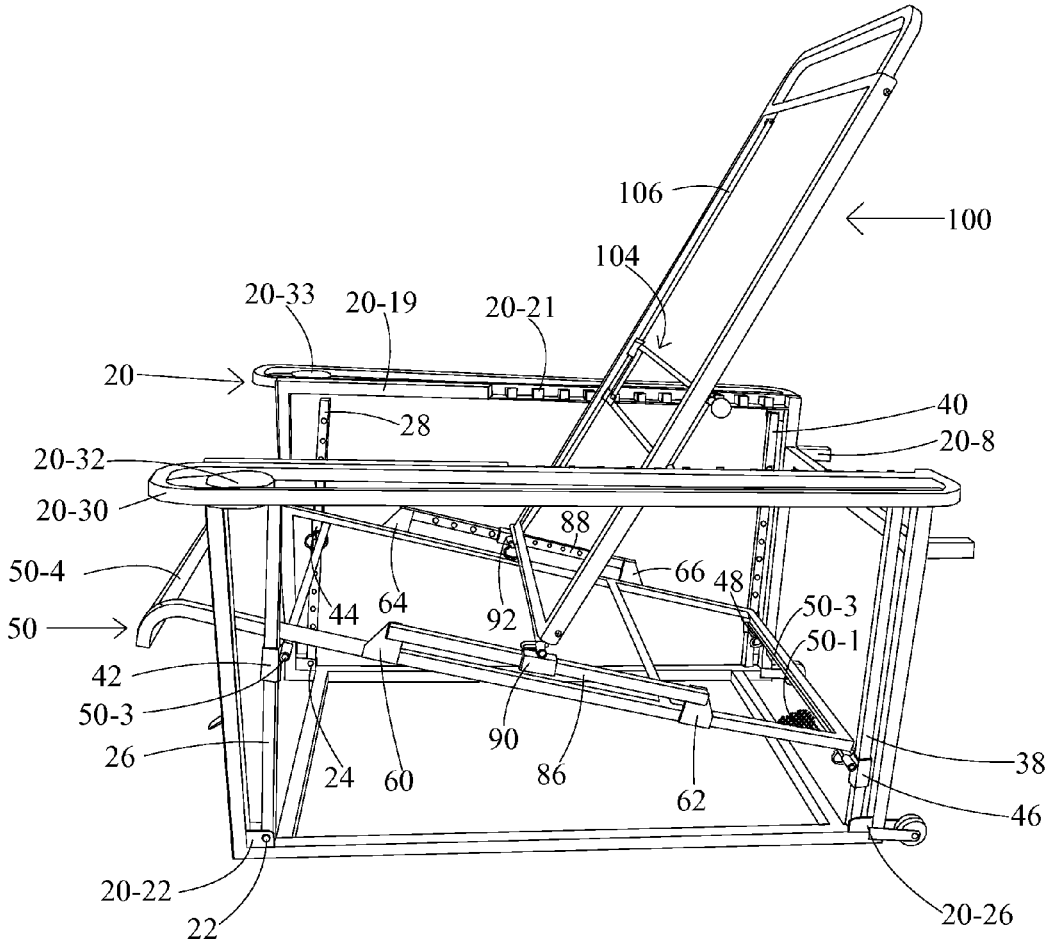
FIG. 2 is a side perspective view showing the skeletal frameworks of the apparatus.
Figure 3:
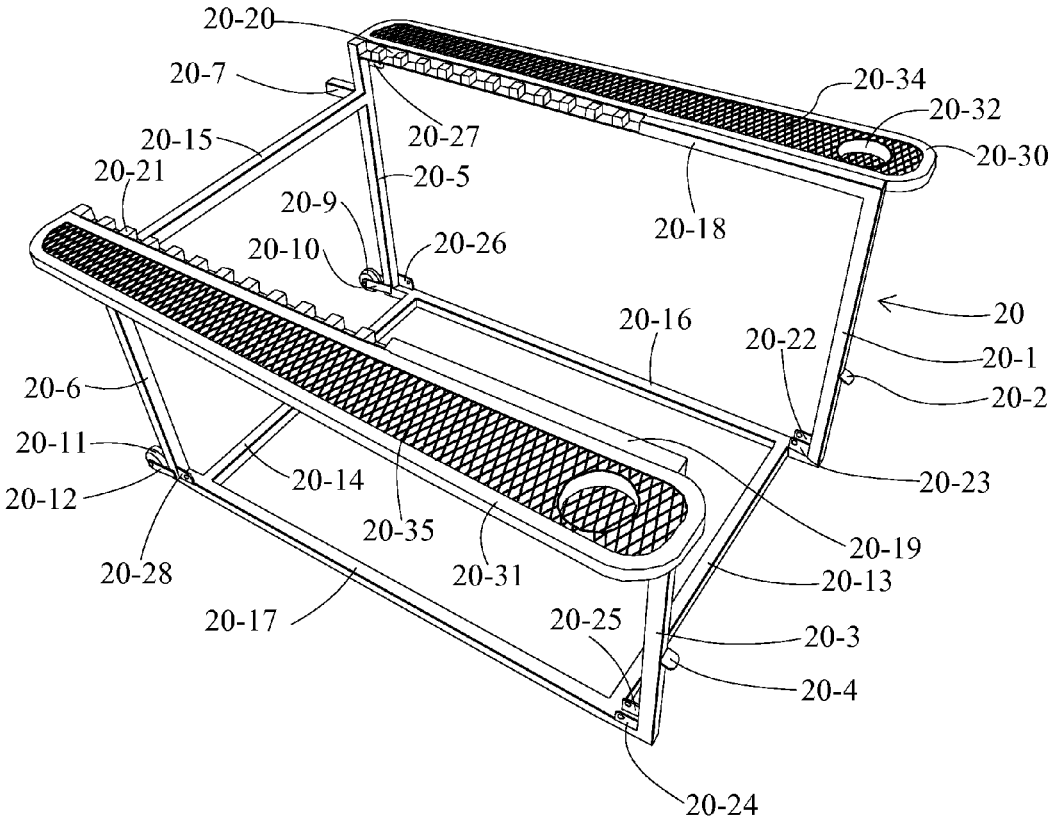
FIG. 3 is a side perspective view of the frame only minus the seat, back, and other components.

LIST OF REFERENCE NUMBERS AND PART NAMES UTILIZED IN THE DRAWINGS AND DETAILED DESCRIPTION

20 Frame Assembly:
- 20-1 Left Front Post
- 20-2 Front Left Recline-Adjustment-Slide Catch
- 20-3 Right Front Post
- 20-4 Front Right Recline-Adjustment-Slide Catch
- 20-5 Left Rear Post
- 20-6 Right Rear Post
- 20-7 Left Upright Propstand
- 20-8 Right Upright Propstand
- 20-9 Left Wheel
- 20-10 Left Wheel Mount
- 20-11 Right Wheel
- 20-12 Right Wheel Mount
- 20-13 Front Lower Crossbar
- 20-14 Rear Lower Crossbar
- 20-15 Rear Upper Crossbar
- 20-16 Left Lower Sidebar
- 20-17 Right Lower Sidebar
- 20-18 Left Upper Solid Rail
- 20-19 Right Upper Solid Rail
- 20-20 Left Upper Notched-Rail-Bar
- 20-21 Right Upper Notched-Rail-Bar
- 20-22 Guidebar Mounting Plate
- 20-23 Guidebar Mounting Plate
- 20-24 Guidebar Mounting Plate
- 20-25 Guidebar Mounting Plate
- 20-26 Guidebar Mounting Plate
- 20-27 Guidebar Mounting Plate
- 20-28 Guidebar Mounting Plate
- 20-29 Guidebar Mounting Plate
- 20-30 Left Armrest
- 20-31 Right Armrest
- 20-32 Left Cup Holder
- 20-33 Right Cup Holder
- 20-34 Left Armrest Surfacing
- 20-35 Right Armrest Surfacing

22 Guidebar Pin

24 Guidebar Pin

26 Front Left Seat Support-Adjustment-Guidebar

28 Front Right Seat Support-Adjustment-Guidebar

38 Rear Left Seat Support-Adjustment-Guidebar

40 Rear Right Seat Support-Adjustment-Guidebar

42 Front Left Seat Adjustment Guide-Latch-Pivot Assembly
- 42-1 Guide Sleeve
- 42-2 Tubular Pivotal Mounting Sleeve
- 43 Spring-Loaded Pin Latch Assembly
- 43-1 Housing
- 43-2 Pin Plunger
- 43-3 Pin Spring
- 43-4 Ring Keeper

44 Front Right Seat Adjustment Guide-Latch-Pivot Assembly
- 44-1 Guide Sleeve
- 44-2 Tubular Pivotal Mounting Sleeve
- 45 Spring-Loaded Pin Latch Assembly
- 45-1 Housing
- 45-2 Pin Plunger
- 45-3 Pin Spring
- 45-4 Ring Keeper

46 Rear Left Seat Adjustment Guide-Latch-Pivot Assembly
- 46-1 Guide Sleeve
- 46-2 Tubular Pivotal Mounting Sleeve
- 47 Spring-Loaded Pin Latch Assembly
- 47-1 Housing
- 47-2 Pin Plunger
- 47-3 Pin Spring
- 47-4 Ring Keeper

48 Rear Right Seat Adjustment Guide-Latch-Pivot Assembly
- 48-1 Guide Sleeve
- 48-2 Tubular Pivotal Mounting Sleeve
- 49 Spring-Loaded Pin Latch Assembly
- 49-1 Housing
- 49-2 Pin Plunger
- 49-3 Pin Spring
- 49-4 Ring Keeper

50 Seat
- 50-1 Seat Surfacing
- 50-2 Front Pivotal Mounting Rod
- 50-3 Rear Pivotal Mounting Rod
- 50-4 Seat Frame

60 Guidebar Mounting Plate

62 Guidebar Mounting Plate

64 Guidebar Mounting Plate

66 Guidebar Mounting Plate

86 Left Lower Backrest Support-Adjustment-Guidebar

88 Right Lower Backrest Support-Adjustment-Guidebar

90 Left Lower Backrest Adjustment Guide-Latch-Pivot Assembly
- 90-1 Guide Sleeve
- 90-2 Tubular Pivotal Mounting Sleeve
- 91 Spring-Loaded Pin Latch Assembly
- 91-1 Housing
- 91-2 Pin Plunger
- 91-3 Pin Spring
- 91-4 Ring Keeper

92 Right Lower Backrest Adjustment Guide-Latch-Pivot Assembly
- 92-1 Guide Sleeve
- 92-2 Tubular Pivotal Mounting Sleeve
- 93 Spring-Loaded Pin Latch Assembly
- 93-1 Housing
- 93-2 Pin Plunger
- 93-3 Pin Spring
- 93-4 Ring Keeper

100 Backrest
- 100-1 Backrest Surfacing
- 100-2 Lower Backrest Pivotal Mounting Rod
- 100-3 Handle Bar
- 100-4 Left Sidebar
- 100-5 Right Sidebar

104 Backrest Recline-Adjustment-Slide Assembly
- 104-1 Lower Stop Rod
- 104-2 Upper Handle Bar
- 104-3 Lower Left Slide Guide
- 104-4 Upper Left Slide Guide
- 104-5 Lower Right Slide Guide
- 104-6 Upper Right Slide Guide
- 104-7 Left Slide Guide Connector
- 104-8 Right Slide Guide Connector

106 Left Backrest Recline-Adjustment-Slide-Guiderod

108 Right Backrest Recline-Adjustment-Slide Guiderod

DETAILED DESCRIPTION

Referring to FIGS. 1, 2, 3, 7, 8, 9, and 10, one embodiment of a multi-adjustable multi-position seating apparatus includes a frame assembly 20 which is comprised of a vertically standing rectangular left side and a right side connected laterally by crossbars. The left side of frame 20 is comprised of left front post 20-1 with front left recline-adjustment-slide catch 20-2 affixed on the forward facing surface. Post 20-1 is connected on the bottom to left lower sidebar 20-16 which is connected to left rear post 20-5 on the opposite rear end. Guidebar mounting plate 20-22 is secured on the outer surface of the outer side, and guidebar mounting plate 20-23 is affixed on the outer surface on the inner side, of the corner created at the connection of post 20-1 and sidebar 20-16. Guidebar mounting plate 20-26 is secured on the outer surface of the outer side of the corner created at the connection of sidebar 20-16 and post 20-5. Post 20-5 is connected at the top to left upper notched-rail-bar 20-20 which makes up the inside back portion of the left armrest. Notched-rail-bar 20-20 is composed of intermittently spaced lugs, fingers, teeth, or stops stout enough to stop or hold the backrest in its reclined position. Notched-rail-bar 20-20 is connected to left upper solid rail 20-18, which is connected on the opposite front end to the top of post 20-1 to form the main rectangle of the left side of frame 20. Guidebar mounting plate 20-27 is affixed on the outer surface on the outer side of the corner created at the connection of post 20-5 and notched-rail-bar 20-20. Left armrest 20-30 is attached alongside rail 20-18 and notched-rail-bar 20-20. Armrest 20-30 comprises left armrest surfacing 20-34 and left cup holder 20-32.

The right side of frame 20 is comprised of right front post 20-3 with front right recline-adjustment-slide catch 20-4 affixed on the forward facing surface. Post 20-3 is connected on the bottom to right lower sidebar 20-17 which is connected to right rear post 20-6 on the opposite rear end. Guidebar mounting plate 20-24 is secured on the outer surface of the outer side, and guidebar mounting plate 20-25 is affixed on the outer surface on the inner side, of the corner created at the connection of post 20-3 and sidebar 20-17. Guidebar mounting plate 20-28 is secured on the outer surface of the outer side of the corner created at the connection of sidebar 20-17 and post 20-6. Post 20-6 is connected at the top to right upper notched-rail-bar 20-21 which makes up the inside back portion of the right armrest. Notched-rail-bar 20-21 is composed of intermittently spaced lugs, fingers, teeth, or stops stout enough to stop or hold the backrest in its reclined position. Notched-rail-bar 20-21 is connected to right upper solid rail 20-19, which is connected on the opposite front end to the top of post 20-3 to form the main rectangle of the right side of frame 20. Guidebar mounting plate 20-29 is affixed on the outer surface on the outer side of the corner created at the connection of post 20-6 and notched-rail-bar 20-21. Right armrest 20-31 is attached alongside rail 20-19 and notched-rail-bar 20-21. Armrest 20-31 comprises right armrest surfacing 20-35 and right cup holder 20-33.

The left and right sides of frame 20 are connected laterally by front lower crossbar 20-13 and rear lower crossbar 20-14 affixed to sidebars 20-16 and 20-17, and rear upper crossbar 20-15 affixed to posts 20-5 and 20-6. Left wheel mount 20-10 extends rearwardly from the bottom rear face of post 20-5 and left wheel 20-9 is attached to mount 20-10. Right wheel mount 20-12 extends rearwardly from the bottom rear face of post 20-6 and right wheel 20-11 is attached to mount 20-12. Left upright propstand 20-7 extends rearwardly on post 20-5 at the junction of crossbar 20-15 and right upright propstand 20-8 extends rearwardly on post 20-6 at the junction of crossbar 20-15 thus completing frame assembly 20.

Front left seat support-adjustment-guidebar 26, an elongated bar or tube containing a plurality of intermittent holes along its length, holes of size sufficient to easily insert pin plunger 43-2 in front left seat adjustment-guide-latch-pivot assembly 42, is pinned between plates 20-22 and 20-23 with guidebar pin 22. Front right seat support-adjustment-guidebar 28, an elongated bar or tube containing a plurality of intermittent holes along its length, holes of size sufficient to easily insert pin plunger 45-2 in front right seat adjustment guide-latch-pivot assembly 44, is pinned between plates 20-24 and 20-25 with guidebar 24. Support-adjustment-guidebars 26 and 28 are mounted by pins between two plates only on the bottom to allow the guidebars to pivot with the changing of the incline of the seat. Rear left seat support-adjustment-guidebar 38, an elongated bar or tube containing a plurality of intermittent holes along its length, holes of size sufficient to easily insert pin plunger 47-2 in rear left seat adjustment guide-latch-pivot assembly 46, is secured at the bottom to plate 20-26 and at the top to plate 20-27. Rear right seat support-adjustment-guidebar 40, an elongated bar or tube containing a plurality of intermittent holes along its length, holes of size sufficient to easily insert pin plunger 49-2 in rear right seat adjustment guide-latch-pivot assembly 48, is secured at the bottom to plate 20-28 and at the top to plate 20-29.

Front left seat adjustment guide-latch-pivot assembly 42 is comprised of guide sleeve 42-1 of shape and size to fit over and slide up and down, or slidably receive, guidebar 26; tubular pivotal mounting sleeve 42-2 of size to easily insert and pivot or rotate front pivotal mounting rod 50-2 on seat 20; and commercially available or constructible spring-loaded pin latch assembly 43. Latch assembly 43 is comprised of latch housing 43-1, pin plunger 43-2, pin spring 43-3, and ring keeper 43-4.

Front right seat adjustment guide-latch-pivot assembly 44 is comprised of guide sleeve 44-1 of shape and size to fit over and slide up and down, or slidably receive, guidebar 28; tubular pivotal mounting sleeve 44-2 of size to easily insert and pivot or rotate front pivotal mounting rod 50-2 on seat 20; and commercially available or constructible spring-loaded pin latch assembly 45. Latch assembly 45 is comprised of latch housing 45-1, pin plunger 45-2, pin spring 45-3, and ring keeper 45-4.

Rear left seat adjustment guide-latch-pivot assembly 46 is comprised of guide sleeve 46-1 of shape and size to fit over and slide up and down, or slidably receive, guidebar 38; tubular pivotal mounting sleeve 46-2 of size to easily insert and pivot or rotate rear pivotal mounting rod 50-3 on seat 20; and commercially available or constructible spring-loaded pin latch assembly 47. Latch assembly 47 is comprised of latch housing 47-1, pin plunger 47-2, pin spring 47-3, and ring keeper 47-4.

Rear right seat adjustment guide-latch-pivot assembly 48 is comprised of guide sleeve 48-1 of shape and size to fit over and slide up and down, or slidably receive, guidebar 40; tubular pivotal mounting sleeve 48-2 of size to easily insert and pivot or rotate rear pivotal mounting rod 50-3 on seat 20; and commercially available or constructible spring-loaded pin latch assembly 49. Latch assembly 49 is comprised of latch housing 49-1, pin plunger 49-2, pin spring 49-3, and ring keeper 49-4

Seat 50 is comprised of seat frame 50-4, seat surfacing 50-1, front pivotal mounting rod 50-2, and rear pivotal mounting rod 50-3. Seat 50 is mounted to frame 20 via guide-latch-pivots 42, 44, 46, and 48. In mounting seat 50 to frame 20, guide-latch-pivot 42 is placed on guidebar 26, guide-latch-pivot 44 is placed on guidebar 28, guide-latch-pivot 46 is place on guidebar 38, and guide-latch-pivot 48 is placed on guidebar 40. Rod 50-2 is inserted into sleeves 42-2 and 44-2 on guide-latch-pivots 42 and 44 and rod 50-3 is inserted into sleeves 46-2 and 48-2 on guide-latch-pivots 46 and 48.

Left lower backrest adjustment guide-latch-pivot assembly 90 is comprised of guide sleeve 90-1 of shape and size to fit over and slide up and down, or slidably receive, guidebar 86; tubular pivotal mounting sleeve 90-2 of size to easily insert and pivot or rotate lower backrest pivotal mounting rod 100-2 on backrest 100; and commercially available or constructible spring-loaded pin latch assembly 91. Latch assembly 91 is comprised of housing 91-1, pin plunger 91-2, pin spring 91-3, and ring keeper 91-4.

Right lower backrest adjustment guide-latch-pivot assembly 92 is comprised of guide sleeve 92-1 of shape and size to fit over and slide up and down, or slidably receive, guidebar 88; tubular pivotal mounting sleeve 92-2 of size to easily insert and pivot or rotate lower backrest pivotal mounting rod 100-2 on backrest 100; and commercially available or constructible spring-loaded pin latch assembly 93. Latch assembly 93 is comprised of housing 93-1, pin plunger 93-2, pin spring 93-3, and ring keeper 93-4.

Guidebar mounting plates 60 and 62 are secured to the left side of frame 50-4 and guidebar mounting plates 64 and 66 are secured to the right side of frame 50-4. Left lower backrest support-adjustment-guidebar 86, an elongated bar or tube containing a plurality of intermittent holes along its length, holes of size sufficient to easily insert pin plunger 91-2 in left lower backrest adjustment guide-latch-pivot assembly 90, is secured at the bottom to plate 20-26 and at the top to plate 20-27, is secured in the front to plate 60 and the rear to plate 62. Right lower backrest support-adjustment-guidebar 88, an elongated bar or tube containing a plurality of intermittent holes along its length, holes of size sufficient to easily insert pin plunger 93-2 in left lower backrest adjustment guide-latch-pivot assembly 92, is secured in the front to plate 64 and in the rear to plate 66.

Backrest 100 is comprised of backrest surfacing 100-1, lower backrest pivotal mounting rod 100-2, handle bar 100-3, left sidebar 100-4, and right sidebar 100-5. Backrest 100 is pivotally mounted via guide-latch-pivots 90 and 92. Guide-latch-pivot 90 is placed on guidebar 86, guide-latch-pivot 92 is placed on guidebar 88, rod 100-2 is inserted into sleeves 90-2 and 92-2 thereby slidably and pivotally attaching backrest 100 to seat 50.

Backrest 100 recline angle is stabilized by backrest recline-adjustment-slide assembly 104. Slide 104 is comprised of lower stop rod 104-1, upper handle bar 104-2, lower left slide guide 104-3, upper left slide guide 104-4, lower right slide guide 104-5, upper right slide guide 104-6, left slide guide connector 104-7, and right slide guide connector 104-8. Slide guides 104-3, 4, 5, and 6 are of shape and size to fit over and easily slide up and down, or slidably receive, left and right backrest recline-adjustment-slide-guiderods 106 and 108. Guiderod 106 and is inserted through guides 104-3 and 4 and secured on the backside at the bottom and top of left sidebar 100-4. Guiderod 108 is inserted through guides 104-5 and 6 and secured on the backside at bottom and top of right sidebar 100-5. Guiderods 106 and 108 are secured such to leave sufficient space to allow free slidability of slide 104.

Operation

Referring to FIGS. 1, 4, 5, 6, 8, and 9, operation of one embodiment of a multi-adjustable multi-position seating apparatus is as follows:

To adjust the front of seat 50 height, user simultaneously pulls on rings 43-4 and 45-4 retracting pin plungers 43-2 and 45-2 from holes in guidebars 26 and 28. Guide-latch-pivots 42 and 44 are then free to move up or down guidebars 26 and 28. User moves front of seat to desired location, releases rings 43-2 and 45-2 allowing pin plungers 43-2 and 45-2 to enter corresponding holes in guidebars 26 and 28 thereby stabilizing front of seat 50 height location.

To adjust the rear of seat 50 height, user pulls on rings 47-4 and 49-4 retracting pin plungers 47-2 and 49-2 from holes in guidebars 38 and 40. Guide-latch-pivots 46 and 48 are then free to move up or down guidebars 38 and 40. User moves back of seat to desired location, releases rings 47-4 and 49-4 allowing pin plungers 47-2 and 49-2 to enter corresponding holes in guidebars 38 and 40 thereby stabilizing rear of seat 50 height location.

To adjust the front/rear location of the bottom of backrest 100, or the distance from the front of seat 50 to the bottom of backrest 100, user pulls on rings 91-4 and 93-4 retracting pin plungers 91-2 and 93-2 from bores in guidebars 86 and 88. Guide-latch-pivots 90 and 92 are then free to move forward or backward on guidebars 86 and 88. User moves bottom of backrest to desired location, releases rings 91-4 and 93-4 allowing pin plungers 91-2 and 93-2 to enter corresponding holes in bars 86 and 88 thereby stabilizing the bottom of backrest 100.

To adjust the reclining angle of backrest 100, slide 104 is pulled upward raising rod 104-1 clear of notched-rail-bars 20-20 and 20-21. Backrest is moved to desired angle and slide 104 is released to allow rod 104-1 to rest against the corresponding lug or figure on notched-rail-bars 20-20 and 20-21.

To transport, both front and rear of seat 50 are placed in the lower settings using the above described method, then slide 104 is pulled upward sufficiently to allow backrest 100 to be rotated forward until it is parallel to seat 50. Slide 104 is moved to allow rod 104-1 to rest under and against catches 20-2 and 20-4. Handle 100-3 is lifted thereby lifting the front of the apparatus off of the surface or ground leaving only wheels 20-9 and 20-11 in contact with the surface or ground resulting in the seating apparatus taking on a wheelbarrow-like orientation. The handle can continue to be raised higher tilting the apparatus over onto the rear until propstands 20-7- and 20-8 contact the surface or ground and the apparatus will be in a stabilized vertical position.

Figure 4:
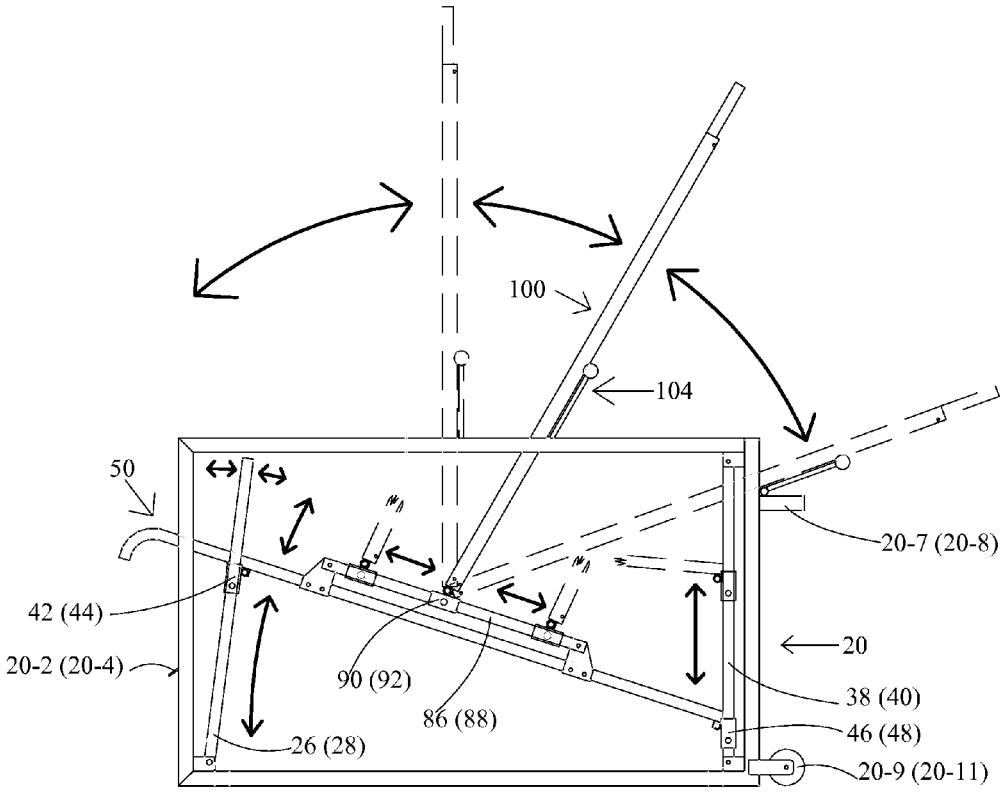
FIG. 4 is a side schematic view showing adjustability and rotatability paths of the seat and backrest.
Figure 5:
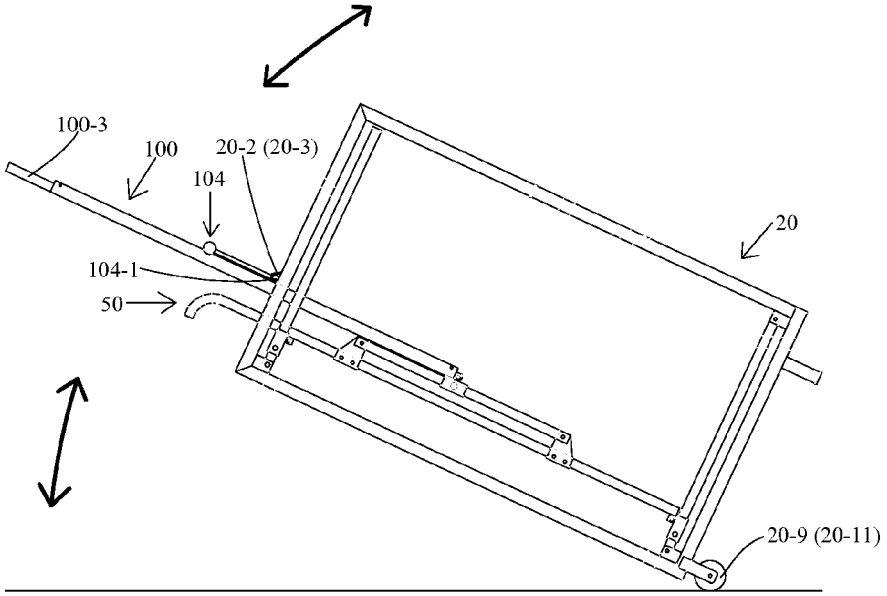
FIG. 5 is a side schematic view showing the wheel-barrow-like mobility.
Figure 6:
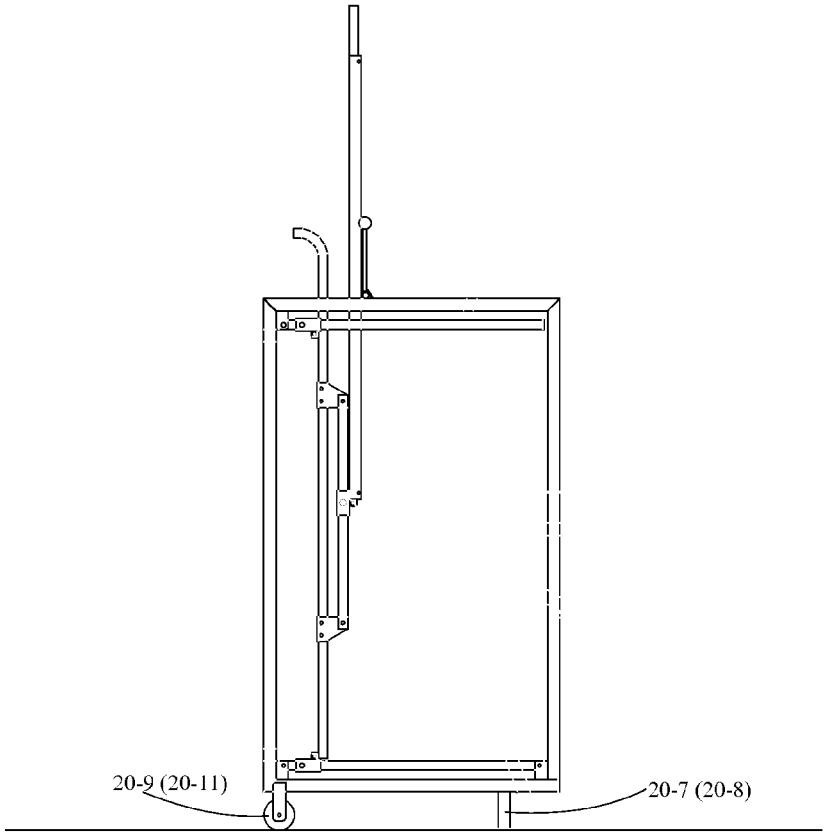
FIG. 6 is a side schematic view showing the upright storage orientation.
Figure 7:
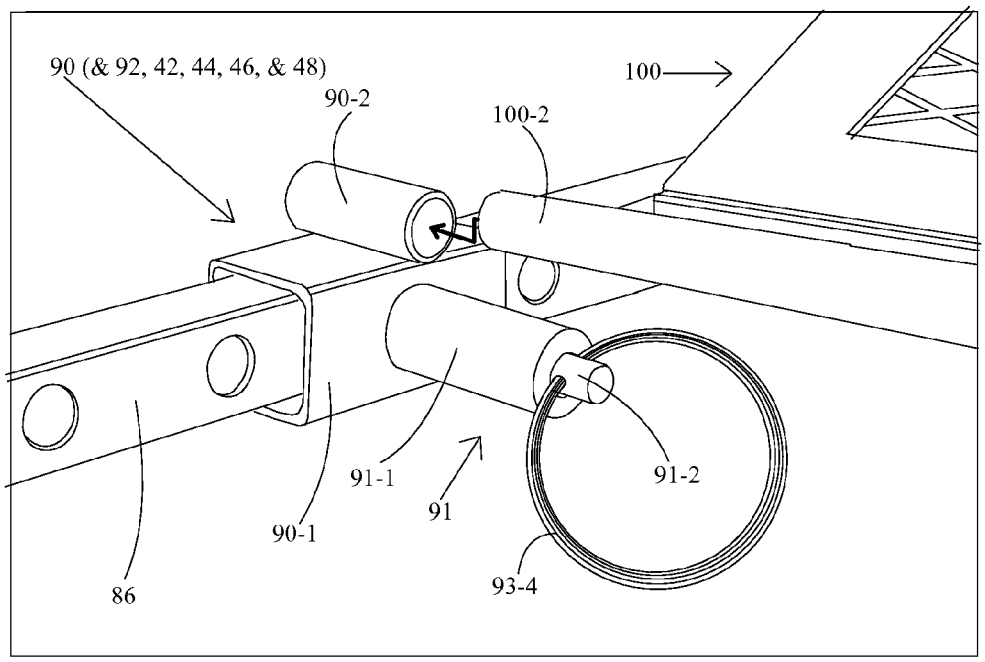
FIG. 7 is a close-up perspective of an adjustment guide-latch-pivot assembly.
Figure 8:
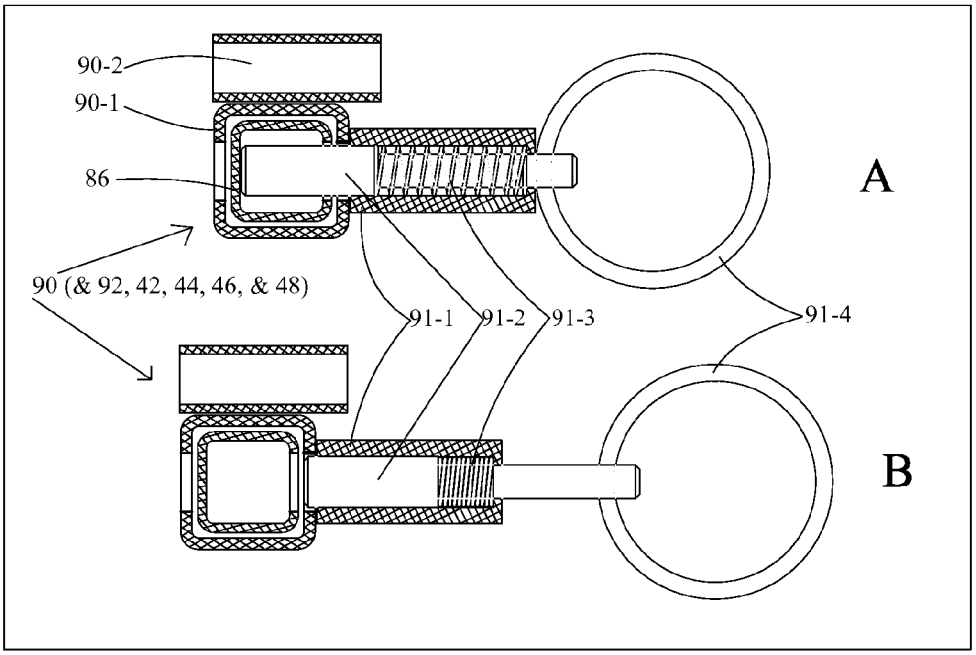
FIG. 8 is a cut-a-way sectional side view of a guide-latch-pivot assembly showing the engaged (A) and disengaged (B) positions.
Figure 9:
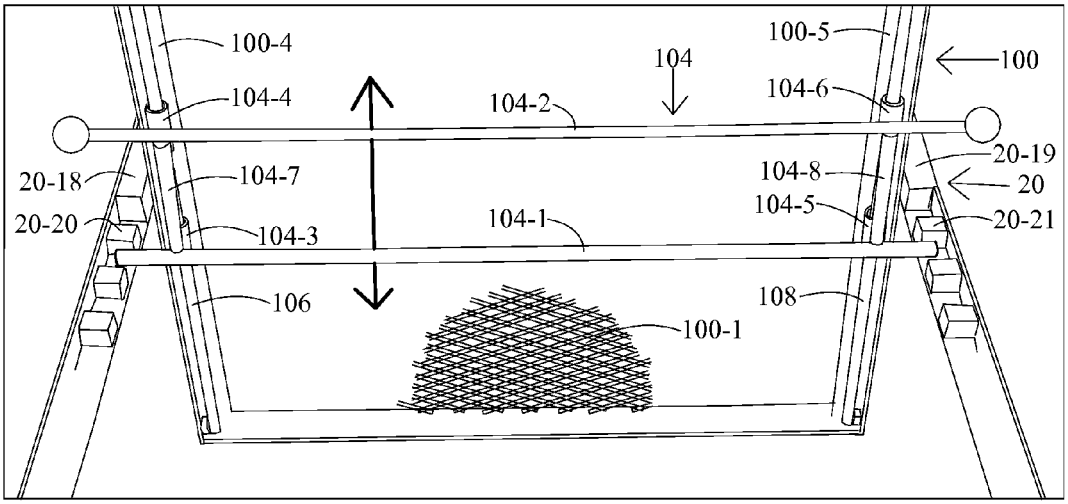
FIG. 9 is a close-up perspective/schematic view showing the backrest recline-adjustment-slide assembly.
Figure 10:
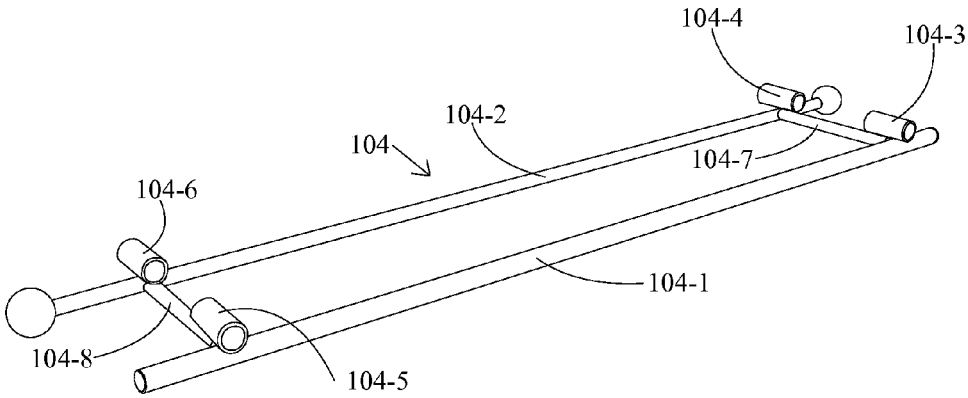
FIG. 10 is a perspective view of the backrest recline-adjustment-slide assembly.

FIG. 4 shows the routes of travel of all of the moveable, adjustable, pivotable components of one embodiment of a multi-adjustable multi-position seating apparatus. The front of seat 50 pivots centered off of the rear mounting rod 50-3 and guide-latch-pivots 46 and 48. The rear of seat 50 pivots centered off of the front mounting rod 50-2 and guide-latch-pivots 42 and 44. Seat 50 can travel in a straight up or down direction by releasing guide-latch-pivots 42, 44, 46, and 48 simultaneously. Guidebars 26 and 28 pivot in a rearward or frontward direction depending on the incline of seat 50. The orientation of seat 50 shows guidebars 26 and 28 pivoted a few degrees off of 90° vertical. The bottom of backrest 100 moves in a forward or backward direction along guidebars 86 and 88. The top of backrest 100 can travel a radius of almost 180° from a step recline toward the back to horizontal parallel to seat 50.

Alternative Embodiments

While the above description contains many specificities, these should not be construed as limitations on the scope, but rather as an exemplification of one embodiment. Many other variations and modifications are possible.

For example, the structural material that the apparatus is constructed of could be any number of shapes, styles, or configurations. Similarly, the material that the apparatus is constructed of could be any number of materials such as carbon steel, stainless steel, aluminum, plastic, wood, etc. While the drawings appear to show the seating apparatus as likely an outdoor chair, the apparatus could be covered or configured as indoor furniture.

Additional alternative embodiments include: The size of the apparatus or any or all of the components could be increased or decreased. The apparatus could be configured as a flat lounge type chair with a longer seat and/or an alternative mounting structure at the bottom of the backrest and/or back of the seat configuration. One or more of the adjustability capabilities could be eliminated. One or more of the pivot points could be eliminated, for example the bottom of the backrest pivot point or the rear of the seat pivot point. The notched-rail-bars could be configured or constructed any number of ways and configurations of fingers, slots, cut-outs, etc.

While the drawings show dual points of adjustment at each fulcrum, the apparatus could be configured to have a single or multiple adjustment devices to adjust any of the fulcrums. The apparatus could be configured for adjustability while the user is seated. The pivoting configuration could be accomplished using bearings instead of rods and sleeves. Bearings could be applied to aid any of the sliding components. The apparatus could be configured as a glider or swing with the addition of glider or swing accessories. The seat height adjustments could be accomplished via other means including screws with threaded guides, ratchets with grooved bars, mechanisms similar to traditional bumper jacks, electric motors, etc. The backrest reclining angle could be stabilized with any number of alternative mechanisms or configurations, many can be learned in a search of the prior art. The ornamental or aesthetic design of the apparatus could be configured in any number of styles or designs. Any number of mechanical, stylistic, ornamental, or other add-ons could be added to the apparatus. The seat, backrest, and armrest coverings or surfacing could be any number of alternative materials or substances.

With respect to the above numerous possible alternative embodiments, it is obvious that numerous modifications, omissions, substitutions, arrangements, and changes could become obvious to those skilled in the art; therefore, the seating apparatus cannot be limited to the exact embodiment, description, configuration, construction, or operation shown.

CONCLUSION, RAMIFICATIONS, AND SCOPE

The foregoing is considered an illustration of the principles of one embodiment of a multi-adjustable multi-position seating apparatus or chair with an independently adjustable and customizable seat height and incline along with a fully adjustable seat length and backrest reclining angle. At least one embodiment offers a seating apparatus or chair with the adjustability to be customized to fit almost any person of most any size, that allows the seat height and slope to be adjusted to fit most any sitter's desired comfort position, that allows the backrest to be adjusted to change the seat length to fit the leg length and reclining angle desired, and that allows the chair to be easily moved or stored in an upright position.

It is obvious that many variations, changes, and modifications are possible without departing from the scope of the apparatus. Accordingly, the scope should be determined not by the embodiments illustrated, but by the appended claims and their legal equivalents.

What is claimed is:

1. A seating apparatus comprising:

a frame assembly comprising substantially rectangular left and right side members; said side members comprising a front post, rear post, upper rail, and bottom rail in contact with the ground or horizontal surface; said side members oriented in a substantially parallel vertical disposition connected transversely with a plurality of elongated substantially horizontal crossbars; said left and right upper rails comprising notched-rail-bars along some portion of the length comprising a plurality of notches intermittently disposed; said left and right side members comprising mounting plates providing means for attaching seat support-adjustment-guide bars;

a plurality of said seat support-adjustment-guidebars comprising an elongated bar of a predetermined length secured to said mounting plates; said guidebars comprising a plurality of bores intermittently disposed along the length; said guidebars of configuration to slidably engage a guide-latch-pivot assembly;

a plurality of said guide-latch-pivot assemblies each comprising a guide sleeve of configuration to slidably receive a support-adjustment-guidebar; a spring-loaded pin latch assembly with retractable pin compatible with guidebar bores; a tubular sleeve configured to pivotally receive seat and backrest pivoting mounting rods;

a seat comprising a front, rear, left side, and right side; said pivoting mounting rods transversing at front and rear locations of width sufficient to pivotally engage guide-latch-pivots that are slidably engaged on support-adjustment-guidebars that are secured to the frame thereby providing means for adjustably and pivotally mounting the seat to the frame; said seat having mounting plates and support-adjustment-guidebars slidably engaged with guide-latch-pivots secured to the left and right sides providing means for adjustably and pivotally mounting a backrest;

a backrest comprising a bottom, top, left side, right side, front, and backside; said pivoting mounting rod transversing the bottom of width sufficient to pivotally engage said guide-latch-pivots slidably engaged on guidebars mounted on the seat thereby providing means for adjustably and pivotally mounting the backrest to the seat; said backrest having a plurality of recline-adjustment-slide-guiderods mounted lengthwise along the left and right backside of configuration to accommodate slidable engagement with a recline-adjustment-slide assembly;

a recline-adjustment-slide assembly comprising a plurality of tubular slide guides providing means for slidable engagement with said recline-adjustment-slide-guiderods; slide guide connectors connecting slide guides; a transversing upper handle providing assembly rigidity and means for a user to grasp to apply disengaging and engaging force; a lower stop rod of length to transverse the assembly and engage notches on notched-rail-bars on the left and right side members of the frame providing means for stabilizing the backrest vertical recline orientation;

whereby a seating apparatus is provided with multiple position independently adjustable front and rear seat elevation and front to rear incline angle; multiple position independently adjustable backrest whereby bottom of backrest is slidably adjustable forward and rearwardly in relation to the seat front and rear; the recline angle of the backrest is pivotally adjustable to multiple positions and stabilized by notched-rail-bars; whereby the provided seating apparatus can be adjusted and customized to meet the comfortable seating desires of most any user.

2. The seating apparatus of claim 1 further comprising a handle bar transversing the top of the backrest; recline-adjustment-slide catches on the front posts of the left and right side members of the frame; wheels affixed at the bottom of both rear posts;

whereby the backrest is pivotally rotated forwardly to a substantially horizontal position largely parallel to the seat; the recline-adjustment-slide engages the catches on the front posts thereby stabilizing the pivotability of the backrest against the frame; the handle bar lifted raises the front of the apparatus thereby engaging the wheels with the ground or surface providing means for wheelbarrow-like mobility of the seating apparatus.

3. The seating apparatus of claim 2 also comprising one or more propstands affixed vertically apart from said wheels on rear of apparatus; said propstand(s) of length approximate to said wheels;

whereby handle bar having lifted the seating apparatus into a wheelbarrow-like orientation is lifted further until the entire seating apparatus tilts to a vertical orientation engaging the propstand(s) with the ground or surface thereby stabilizing the seating apparatus in a vertical position.

4. The seating apparatus of claim 1 wherein the seat and backrest are surfaced with a material sufficient to support the weight of a user.

5. The seating apparatus of claim 1 further comprising armrests secured alongside the top rail of both left and right side members of the frame.

6. A multiple adjustment multiple position seating apparatus comprising:

A frame assembly, seat assembly, backrest assembly, notched bars, guide bars; guide-latch-pivot assemblies, and recline adjustment assembly;

said frame assembly comprising a first left side member and a second right side member each comprising vertical front and rear posts, horizontal bottom rails contacting the ground or surface, and horizontal top rails comprising said notched bars; said frame side members laterally connected by elongated crossbars;

said seat assembly comprising a front, rear, left side, and right side with a first pivotal mounting means near the front and a second pivotal mounting means at the rear;

said backrest assembly comprising a bottom, top, left side, and right side with pivotal mounting means at the bottom and engagement and slide means along the length for slidably engaging said recline adjustment assembly;

said guide bars comprising an elongated member with slide securing stop means along the length;

said guide-latch-pivot assemblies comprising guide bar engagement means configured to slidably receive guide bars, pivotal engagement means configured to engage seat and backrest pivotal mounting means, and latch means configured to engage guide bar slide securing stop means;

said recline adjustment assembly comprising means to slidably engage said backrest engagement and slide means and also engage notches on said notched bars;

whereby seat is pivotally engaged to guide-latch-pivots that are slidably engaged on guide bars and stabilized with latch means; guide bars are mounted vertically on frame base in proximity to seat pivotal mounting means; backrest is pivotally engaged to guide-latch-pivots that are slidably engaged on guide bars that are secured to seat; recline adjustment mechanism is slidably engaged to backrest engagement and slide means and also engages notches in notched bars thereby stabilizing backrest; whereby a multiple adjustment multiple position seating apparatus is disclosed with an adjustable front and rear of seat, reclining backrest, and adjustable seat/backrest junction.

7. The multiple adjustment multiple position seating apparatus of claim 6 further comprising wheels mounted at the bottom rear of said frame; said backrest also comprising a handle at the top; catches configured to scotch said recline adjustment assembly affixed to front posts of frame;

whereby backrest is rotated forwardly to a horizontal orientation parallel with the ground or surface, recline adjustment assembly engages front post catches whereby handle is lifted away from the ground or surface lifting the front of the seating apparatus and engaging the wheels with the ground or surface providing for wheelbarrow-like mobility.

8. The multiple adjustment multiple position seating apparatus of claim 7 further comprising one or more props affixed to rear of said frame a distance above said wheels of similar length configuration as wheels;

whereby said handle is lifted further tilting the entire seating apparatus onto its rear in a vertical orientation supported by wheels and props.

9. The seating apparatus of claim 6 wherein said seat and backrest are surfaced with a material sufficient to support the weight of a user.

10. The seating apparatus of claim 6 further comprising armrests secured alongside top rails of side members of said frame.

* * * * *